US009243399B2

(12) United States Patent
Kubassek et al.

(10) Patent No.: US 9,243,399 B2
(45) Date of Patent: Jan. 26, 2016

(54) THERMAL CLIP SYSTEM AND APPARATUS FOR A BUILDING WALL ASSEMBLY

(71) Applicants: John David Kubassek, Toronto (CA); Ronald McLean, Mississauga (CA)

(72) Inventors: John David Kubassek, Toronto (CA); Ronald McLean, Mississauga (CA)

( * ) Notice: Subject to any disclaimer, the term of this patent is extended or adjusted under 35 U.S.C. 154(b) by 0 days.

(21) Appl. No.: 13/790,483

(22) Filed: Mar. 8, 2013

(65) Prior Publication Data

US 2014/0026510 A1 Jan. 30, 2014

(51) Int. Cl.

| | |
|---|---|
| ***E04B 1/41*** | (2006.01) |
| ***E04B 2/58*** | (2006.01) |
| *E04B 2/74* | (2006.01) |
| *E04B 1/24* | (2006.01) |

(52) U.S. Cl.

CPC ... *E04B 1/40* (2013.01); *E04B 2/58* (2013.01); *E04B 2/7412* (2013.01); *E04B 2001/2466* (2013.01); *E04B 2001/2481* (2013.01)

(58) Field of Classification Search

CPC ..... E04F 13/0803; E04F 13/0805; E04F 13/0807; E04F 13/0808; E04F 13/0826; E04F 13/007; E04F 13/081; E04B 2/58; E04B 2/7412; E04B 2001/2466; E04B 2001/2481

USPC ..... 52/235, 309.13, 698, 489.1, 489.2, 52/588.1, 483.1, 474, 512, 781.3

See application file for complete search history.

(56) References Cited

U.S. PATENT DOCUMENTS

| | | | | | |
|---|---|---|---|---|---|
| 4,570,401 | A * | 2/1986 | Uebel et al. | 52/235 | |
| 4,833,858 | A * | 5/1989 | Hutchison | 52/475.1 | |
| 4,840,004 | A * | 6/1989 | Ting | E04F 13/0803 52/235 | |
| 4,866,896 | A * | 9/1989 | Shreiner et al. | 52/235 | |
| 5,076,035 | A * | 12/1991 | Wright | 52/464 | |
| 5,092,101 | A * | 3/1992 | Kunert | 52/786.11 | |
| 5,263,292 | A * | 11/1993 | Holland et al. | 52/235 | |
| 5,301,484 | A * | 4/1994 | Jansson | 52/235 | |
| 5,440,854 | A * | 8/1995 | Hohmann | 52/489.1 | |
| 5,860,257 | A * | 1/1999 | Gerhaher et al. | 52/235 | |
| 6,035,598 | A * | 3/2000 | Sukolics et al. | 52/506.08 | |
| 6,098,364 | A * | 8/2000 | Liu | 52/506.08 | |
| 6,226,947 | B1 * | 5/2001 | Bado et al. | 52/483.1 | |
| 6,289,646 | B1 * | 9/2001 | Watanabe | 52/506.01 | |
| 6,315,489 | B1 * | 11/2001 | Watanabe | 403/381 | |
| 7,043,884 | B2 * | 5/2006 | Moreno | 52/235 | |
| 7,726,083 | B2 * | 6/2010 | Wagner | 52/235 | |
| 7,849,651 | B2 * | 12/2010 | Fujito et al. | 52/506.06 | |
| 8,191,327 | B2 * | 6/2012 | Griffiths et al. | 52/506.08 | |
| 2001/0011443 | A1 * | 8/2001 | Watanabe et al. | 52/506.05 | |
| 2003/0110731 | A1 * | 6/2003 | Ritchie | 52/704 | |
| 2003/0150179 | A1 * | 8/2003 | Moreno | 52/235 | |
| 2004/0010998 | A1 * | 1/2004 | Turco | E04F 13/0826 52/762 | |
| 2004/0128930 | A1 * | 7/2004 | Ohnishi | 52/474 | |
| 2006/0265988 | A1 * | 11/2006 | Fujito et al. | 52/511 | |
| 2008/0010922 | A1 * | 1/2008 | Wagner | 52/235 | |

(Continued)

*Primary Examiner* — James Ference

(74) *Attorney, Agent, or Firm* — Bennett Jones LLP

(57) ABSTRACT

A thermal clip system suitable for use with a wall assembly. The clip comprises a base section and an arm section. According to an embodiment, the clip is formed a unitary piece from extruded aluminum. The base section is configured with mounting holes for receiving fasteners to secure the clip respective studs in a wall. The arm section includes a surface for fastening a girt member, wherein the girt member is configured to secure one or more exterior cladding panels. The base section may include a recessed cavity for receiving an insulating material to form a thermal break between the clip and the stud wall. The arm section may include a recessed slot for receiving an insulating material to form a thermal break between the clip and the girt member.

8 Claims, 7 Drawing Sheets

(56) References Cited

U.S. PATENT DOCUMENTS

| | | | | |
|---|---|---|---|---|
| 2009/0031659 | A1* | 2/2009 | Kalfon | 52/404.1 |
| 2009/0049781 | A1* | 2/2009 | Pilz | E04B 1/948 52/481.1 |
| 2010/0031597 | A1* | 2/2010 | Baek | 52/489.1 |
| 2010/0199585 | A1* | 8/2010 | Stevens et al. | 52/475.1 |
| 2010/0251647 | A1* | 10/2010 | Enns | 52/302.1 |
| 2010/0257812 | A1* | 10/2010 | Schultz et al. | 52/704 |
| 2010/0325997 | A1* | 12/2010 | Scully et al. | 52/489.1 |
| 2011/0120031 | A1* | 5/2011 | Scherba | 52/202 |
| 2011/0173902 | A1* | 7/2011 | Hohmann et al. | 52/167.1 |
| 2012/0137610 | A1* | 6/2012 | Knight et al. | 52/309.1 |
| 2012/0167505 | A1* | 7/2012 | Krause | 52/302.1 |
| 2014/0026510 | A1* | 1/2014 | Kubassek et al. | 52/512 |

* cited by examiner

THERMAL CLIP SYSTEM AND APPARATUS FOR A BUILDING WALL ASSEMBLY

FIELD OF THE INVENTION

The present invention relates to wall assemblies and more particularly, to a thermal clip system and apparatus suitable for use with wall assemblies or modules having an outer cladding.

BACKGROUND OF THE INVENTION

In the building arts, insulation of exterior walls is an important design consideration, particularly in northern or extreme climates.

One building system found in the art is an exterior cladding system comprising a framework structure coupled to the exterior wall with exterior cladding panels connected to the framework. The exterior cladding panels can be engineered and fabricated to provide various aesthetic characteristics in addition to useful thermal and weather resistant properties. For example, the cladding panels and frame structure can comprise a rear ventilated rain-screen (RVRS) exterior wall structure.

A shortcoming with these types of systems is the connection between the exterior cladding framework structure and the exterior wall provides a thermal path for the escape of thermal energy, e.g. heat in winter and cooled air in summer. In addition, building code requirements are increasingly specifying improved thermal characteristics. For instance, the current industry standard for attachment of cladding type systems is inefficient in terms of effective R-Value. Compared to the nominal amount of insulation used in the assembly, the thermal resistance of the continuous vertical girt or continuous horizontal girt is typically only 40-60% effective. Therefore, typical traditional systems do not meet the prescriptive requirements of the national building code.

Accordingly, there remains a need for improvements in the art.

BRIEF SUMMARY OF THE INVENTION

The present invention is directed to a thermal clip system, configuration and method suitable for use with a wall assembly or a modular wall or cladding system.

According to one embodiment, the present invention comprises a clip for a wall system, the wall system comprises one or more stud members configured for a wall and one or more girt members configured for connecting one or more external cladding panels, the clip comprises: a base section having a mounting surface and being configured with one or more openings for receiving one or more respective fasteners for securing the base section to the one of the respective stud members; an arm section extending generally perpendicularly from the base section, and the arm section having a surface for supporting and securing a section of one of the girt members; the base member having a recessed cavity formed in a section of the mounting surface, and the recessed cavity being configured for receiving an insulating material so as to provide a thermal break between the base member and the internal wall.

According to another embodiment, the present invention comprises an exterior wall assembly for a building comprising: a backing wall comprising a plurality of stud members arranged in a spaced relationship; a plurality of clip members fastened to respective stud members in the backing wall; a plurality of horizontal girt members, each of the horizontal girt members having a mounting face; a plurality of vertical girt members, each of the vertical girt members being configured for fastening to the mounting face of the respective horizontal girt members to form a frame structure, and one or more of the vertical girt members having a mounting surface for attaching one or more exterior cladding panels; and each of the plurality of clip members comprising, a base section having a mounting surface and being configured with one or more openings for receiving one or more respective fasteners for securing the base section to one of the respective stud members; an arm section extending generally perpendicularly from the base section, and the arm section having a surface for supporting and securing a section of one of the horizontal girt members; the base member having a recessed cavity formed in a section of the mounting surface, and the recessed cavity being configured for receiving an insulating material so as to provide a thermal break between the base member and the internal wall.

According to another embodiment, the present invention comprises a clip for a wall system, the wall system comprising one or more stud members configured for a wall and one or more girt members configured for connecting one or more external cladding panels, the clip comprising: a base section having a mounting surface and being configured with one or more openings for receiving one or more respective fasteners for securing the base section to one of the respective stud members; an arm section extending generally perpendicularly from the base section, and the arm section having a surface for supporting and securing a section of one of the girt members; and the surface of the arm section includes a recessed slot configured for receiving an insulating material so as to provide a thermal break between the girt member and the arm section.

Other aspects and features of the present invention will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example, embodiments of the present invention, and in which:

FIG. 2(*b*) shows a magnified view of the arrangement of the thermal clip, horizontal and vertical girt members of FIG. 2(*a*);

FIG. 4(*b*) is a top view of the thermal clip of FIG. 4(*a*);

FIG. 5(*b*) is a top view of the thermal clip of FIG. 5(*a*);

FIG. 6(*b*) is a top view of the thermal clip of FIG. 6(*a*).

Like reference numerals indicate like or corresponding elements or components in the drawings.

DETAILED DESCRIPTION OF THE EMBODIMENTS OF THE INVENTION

Figure 1:
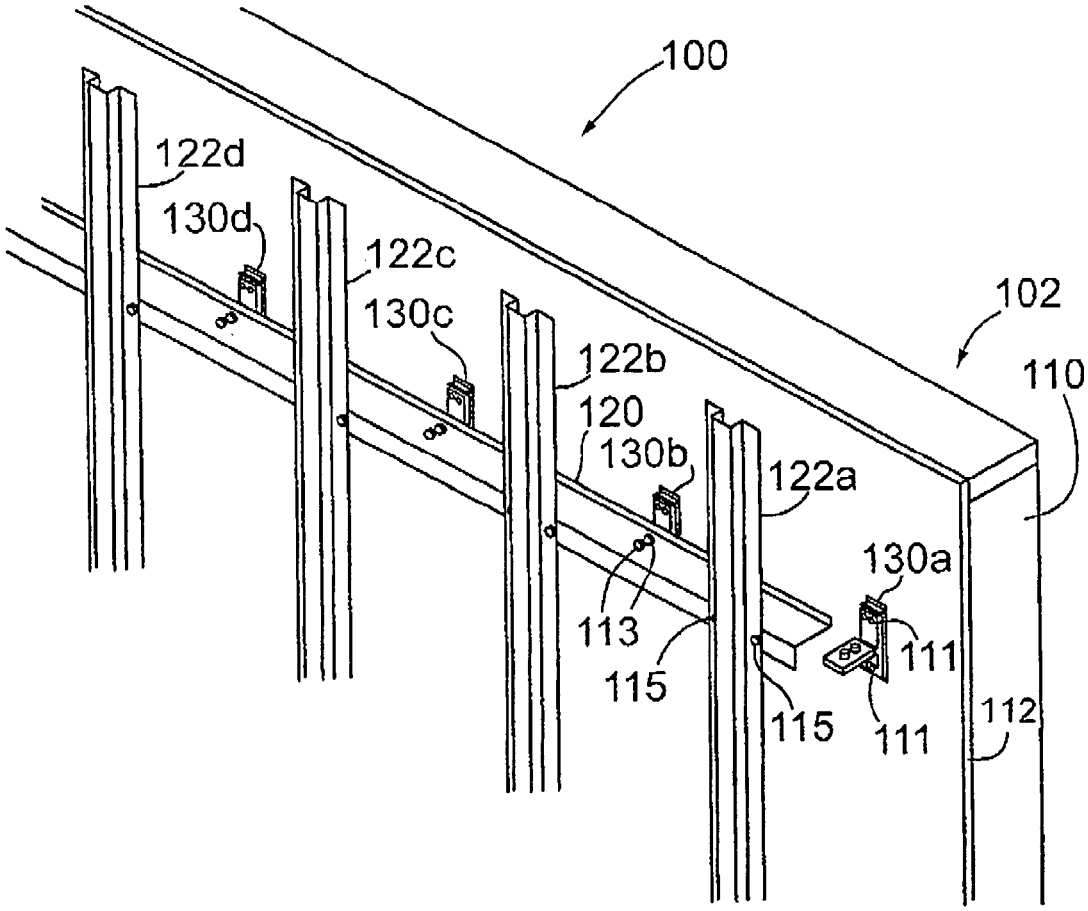
FIG. 1 shows in diagrammatic form a thermal clip and wall configuration according to an embodiment of the present invention.
Figure 2A:
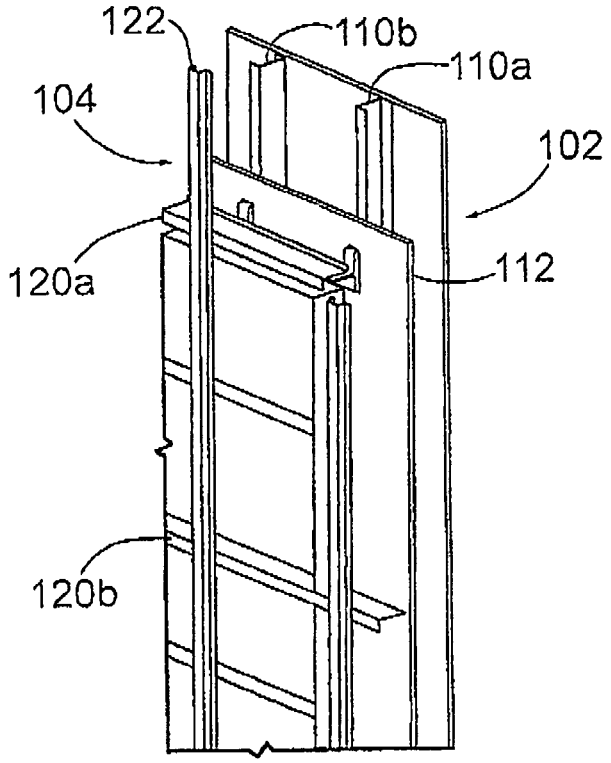
FIG. 2(*a*) shows in diagrammatic form the thermal clip and wall configuration in more detail.
Figure 2B:
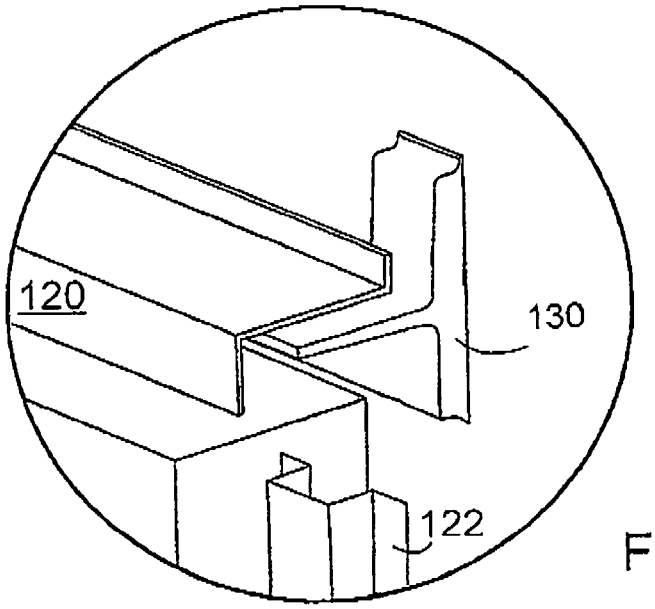
Figure 3A:
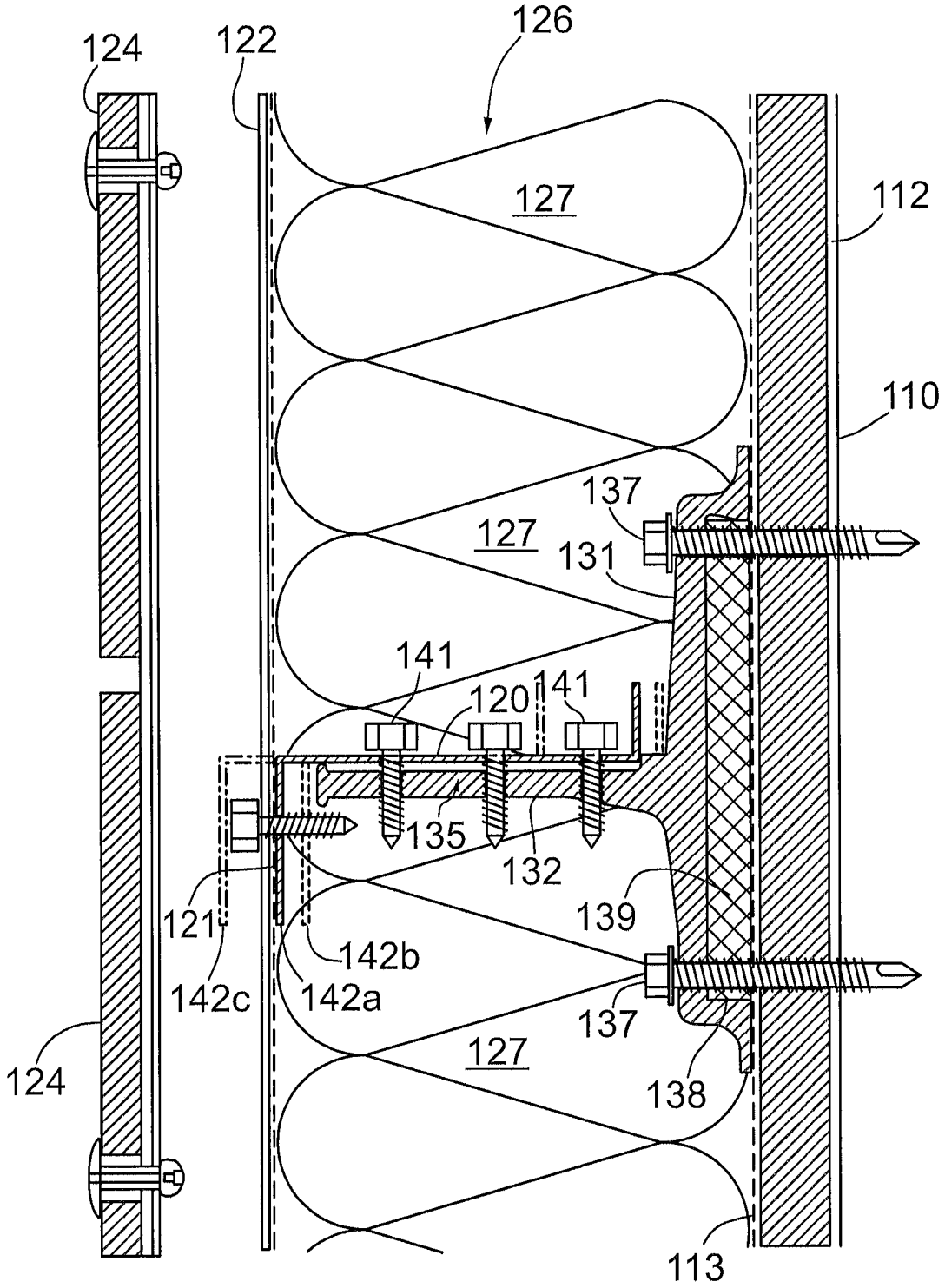
FIGS. 3(*a*) and 3(*b*) show a thermal clip and wall configuration according to an exemplary embodiment.
Figure 3B:
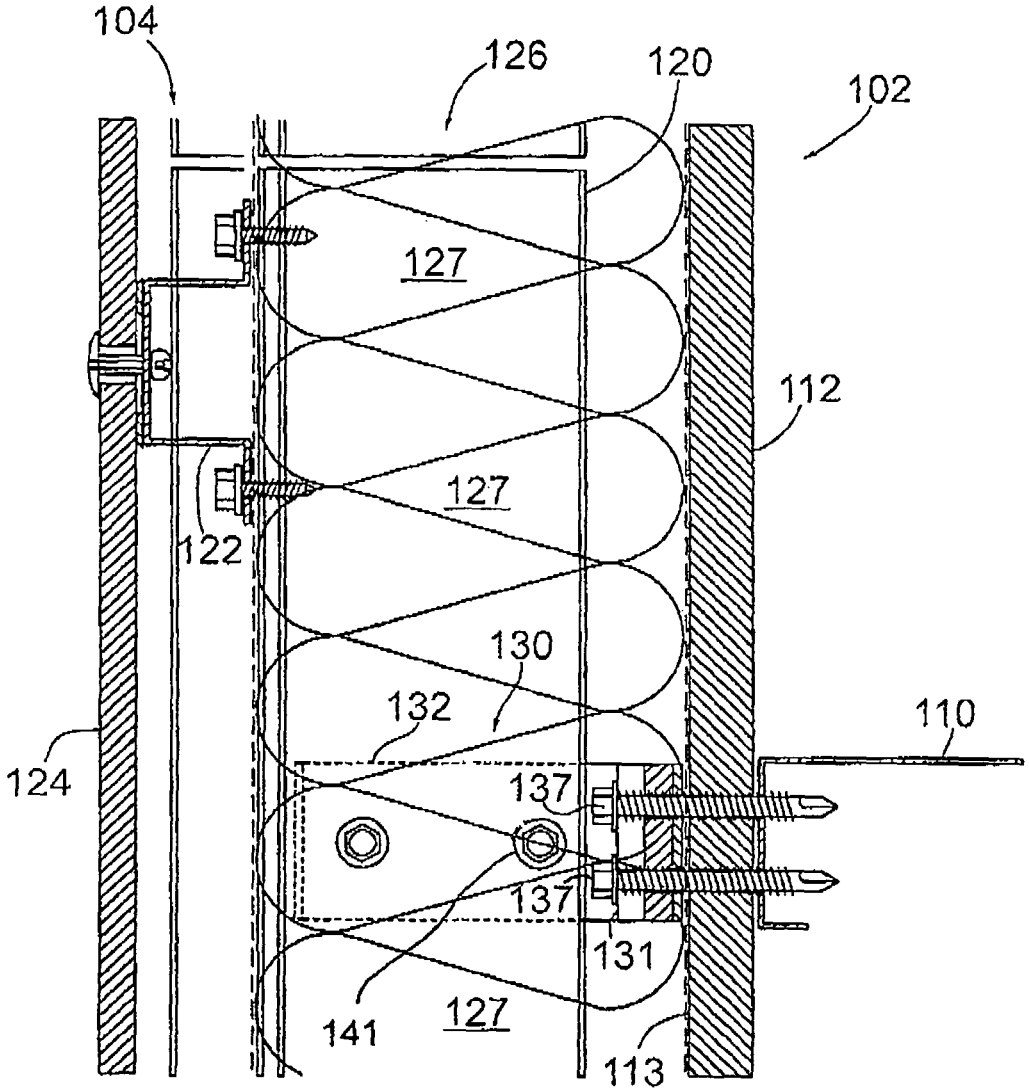

Reference is made to FIGS. 1 and 2(*a*), 2(*b*), which show in diagrammatic form an exemplary wall assembly and configuration comprising a thermal clip assembly or configuration according to an embodiment of the present invention and indicated generally by reference 100. The wall assembly 100 comprises a wall 102 (e.g. an internal stud back-up wall) comprising a wall frame formed with studs 110 (e.g. steel studs) and a sheathing layer 112 (e.g. gypsum/cellulose exterior sheathing panels), and an exterior cladding system indicated generally by reference 104. The exterior cladding system utilizes an arrangement of girts comprising horizontal girt or sub-girt members (e.g. "zee-gifts") 120 and vertical girt members 122. In FIG. 1, the vertical girt members 122 are indicated individually by references 122*a*, 122*b*, 122*c*, 122*d* . . . . The vertical girt members 122 are fastened to the horizontal girt members 120 to form a frame structure for attaching and supporting external cladding sheets or panels 124, for example, as shown in FIGS. 3(*a*) and 3(*b*). The horizontal girt members 120 are attached or affixed to the wall 102 by respective thermal clips 130 indicated individually by references 130*a*, 130*b*, 130*c*, 130*d* . . . as shown in FIG. 1. As will be described in more detail below, each thermal clip 130 is affixed to a respective stud 110 using suitable fasteners or connectors 111 (for example, "self-drilling" hex washer head screws). Similarly, the horizontal girt member 120 is connected to the respective thermal clip members 130 using suitable fasteners 113 (for example, "self-tapping" hex head screws), and the vertical girt member 122 is connected to the respective horizontal girt members 120 using suitable fasteners 115 (for example, "self-drilling" hex washer head screws).

Reference is next made to FIGS. 3(*a*), 3(*b*) and 4(*a*), 4(*b*), which show the thermal clip 130 according to an embodiment in greater detail. The thermal clip 130 comprises a base section 131 and an arm section 132. The arm section 132 is generally perpendicular to the base section 131 and provides a surface for supporting and/or fastening the horizontal girt (i.e. "zee-girt") for example as depicted in FIG. 3(*a*). According to an exemplary implementation, the thermal clip 130 is formed or fabricated from extruded aluminum as a unitary piece. The base member 131 is configured to attach to the wall 102, and according to an embodiment comprises holes 136 (e.g. punched or drilled) for receiving suitable fasteners 137 (e.g. self-drilling hex head screws) that penetrate through the sheathing layer 112 and screw directly into the steel stud 110 (FIG. 3(*b*)) to securely fasten the thermal clip 130 to the wall 102. According to another aspect, the wall 102 can include a vapour barrier layer indicated generally by reference 113 (FIG. 3(*a*)), which is installed in a manner as will be readily understood by one skilled in the art. As also shown in FIGS. 3(*a*) and 4(*a*), the base section 131 may also include feet or extended end sections indicated generally by reference 133. The extended end sections 133 are formed in the base section 131 and facilitate achieving a "flush" connection or distributed load surface between the base section 131 of the thermal clip 130 and the exterior surface of the wall 102.

According to another aspect, the thermal clip 130 comprises a recessed slot or cavity that is formed in the base section 131, e.g. in the surface that mounts against the wall, and indicated generally by reference 138 as shown in FIGS. 3(*a*) and 4(*a*). The recessed slot 138 is configured to receive a high efficient insulating material indicated generally by reference 139, which provides a thermal break between the exterior and interior surfaces of the wall 102. According to an exemplary implementation, the thermal break insulating layer 139 comprises Thermablok™ high performance silica aerogel insulation with a self-adhesive backing layer for securing to the inside surface of the recessed cavity 138. It will however be appreciated that other suitable thermal insulating materials may be used to provide a thermal break.

As shown in FIGS. 3(*a*) and 4(*a*), the arm section 132 is formed to provide a support surface for supporting and fastening the horizontal girts 120 (i.e. sub-girts). According to one aspect, the arm section 132 has a sufficient thickness to support the distributed weight of the horizontal and vertical girt members 120, 122 and the external cladding panels 124 (including the bending moment load). According to an exemplary implementation, the horizontal girt member 120 is connected directly to the arm section 132 of the thermal clip 130 using a suitable fastener indicated generally by reference 141, such as self-tapping hex head screws, which are screwed directly into the body of the arm section 132. According to another aspect, the arm section 132 is configured to allow the horizontal girt 120 to be positioned (and fastened) in more than location, i.e. offset or extending outwards from the base section 131, as indicated by references 142*a*, 142*b* and 142*c* in FIG. 3(*a*). According to an exemplary implementation, the arm section 132 is configured to provide a span in the range of approximately 90 mm. According to another aspect, the size or span of the thermal clip 130 is determined by the thickness of the required or specified insulation layer 127 (for example as depicted in FIG. 3(*a*)).

As shown in FIGS. 3(*a*) and 4(*a*), the thermal clip 130 may include another thermal break section according to an embodiment of the invention. As shown, the arm section 132 includes a recessed slot or cavity indicated generally by reference 135 and configured for receiving a thermal insulating material indicated generally by reference 139. As shown in FIG. 3(*a*), the thermal insulating layer 139 is effectively "sandwiched" between the horizontal sub-girt member 120 and the arm section 132 of the thermal clip 130. Since both of these components may be formed of a metallic material, the thermal insulating layer 139 provides a thermal break, i.e. thermal barrier. According to an exemplary implementation, the thermal insulating layer 139 comprises cork-neoprene material, for example, High-Tensile Cork-Neoprene Tape from Jacobs & Thompson.

Referring to FIGS. 3(*a*) and 3(*b*), the horizontal girt 120 includes a front flange or face 121, which is configured to provide a mounting surface for securing the respective vertical girt member 122. According to an exemplary implementation, the vertical girt member 122 is secured to the horizontal girt member 120 utilizing self-drilling type hex head screws. As also shown in FIGS. 3(*a*) and 3(*b*), the external cladding sheets or panels 124 are secured to respective sections of the vertical girt members 122 using suitable fasteners 125, such as, stainless steel rivets with a separate stainless steel filler cylinder. According to an exemplary implementation, the external cladding panels 124 and the horizontal girts 120 and the vertical girts 122 comprise a rear ventilated rain screen (RVRS) structure. These and other particular implementation and assembly details will be within the understanding of one skilled in the art. A void indicated generally by reference 126 is formed between the wall 102 and the external cladding layer 124 as depicted in FIGS. 3(*a*) and 3(*b*). In known manner, the void 126 serves to provide a thermal break (and ventilation path or space). According to another aspect, the thermal properties of the void 126 may be improved by installing an insulation layer indicated generally by reference 127, for example, Roxulplus™ semi-rigid mineral wool insulation.

According to another embodiment, the wall 102 comprises a slab structure and the thermal clips 130 are configured to be fastened to respective sections of the slabs, in addition to the studs 110.

Figure 5B:
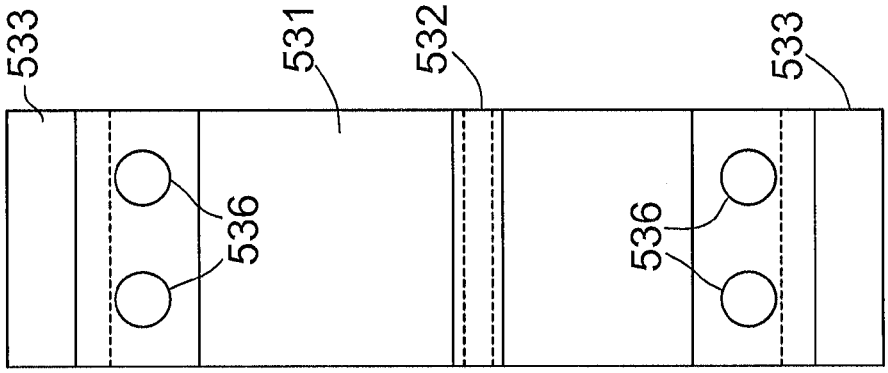
FIG. 5(*a*) is a side view of a thermal clip according to another embodiment of the present invention.
Figure 5A:
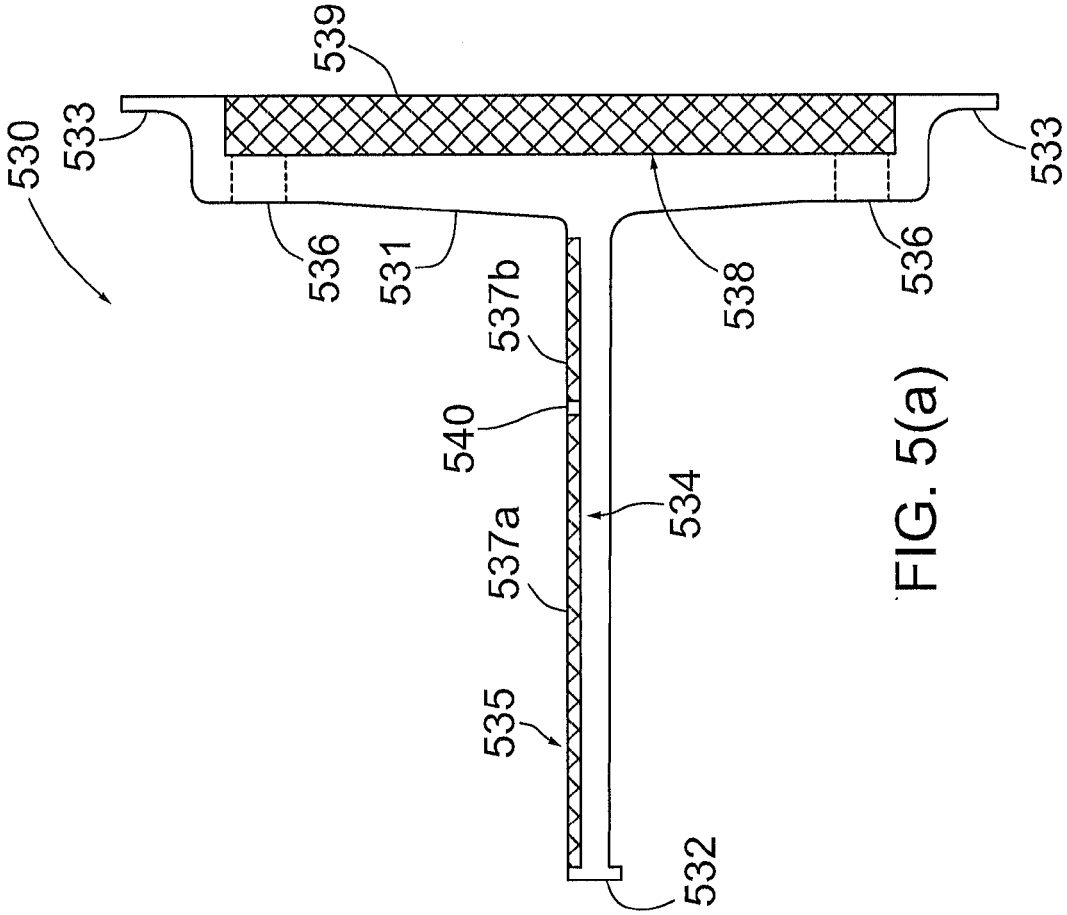

Reference is next made to FIGS. 5(*a*) and 5(*b*), which show a thermal clip according to another embodiment of the invention and indicated generally by reference 530. The thermal clip 530 comprises a base section 531 and an arm section 532. The base section 531 is configured with openings 536 for receiving fasteners and securing the thermal clip to studs 110 in the wall 102, for example, as described above with reference to FIG. 3(*a*). The base section 530 may also include extended sections or feet indicated generally by reference 533 to provide a larger or increased mounting surface for securing the base section 531 against the wall 102 and/or distributing the structural load. As described above with reference to FIGS. 3(*a*) and 3(*b*), the arm section 532 is generally perpendicular to the base section 531 and provides a surface for supporting and/or fastening the horizontal girt 120 (i.e. zee-girt). According to this embodiment, the longitudinal dimension of the arm section 532 has been increased, for example, to approximately 115 mm, in order to provide a greater span between the exterior wall 102 (FIG. 3(*a*)) and the exterior cladding layer 124 (FIG. 3(*a*)). According to an exemplary implementation, the thermal clip 530 is formed from extruded aluminum as a unitary piece. With the increased span (i.e. length) of the arm section 532 the thickness and/or material composition is suitably modified to accommodate the increased structural loading (e.g. bending moment loading).

As shown in FIG. 5(*a*), the thermal clip 530 may be configured with a recessed slot or cavity 538 in the base section 531 and/or a recessed slot or cavity 534 in the arm section 532. As described above for the thermal clip 130, the recessed slots 534, 536 are configured to receive or hold an insulating material 535, 539 and provide a thermal break between the thermal clip 530 and the exterior wall 102, and the horizontal sub-girt 120 (FIG. 3(*a*)) and the thermal clip 530, respectively. According to another aspect, the recessed slot 534 includes a cross-rib 540 which effectively divides the slot 534 into two sections 537*a* and 537*b*. The cross-rib 540 provides support surface for supporting the horizontal sub-girt 120 when it is mounted away from the base section 531, for example, in position 142*c* (FIG. 3(*a*)). With this configuration, each of the slot sections 537*a* and 537*b* is configured to receive an insulating material or strip, for example, as described above.

Figure 4B:
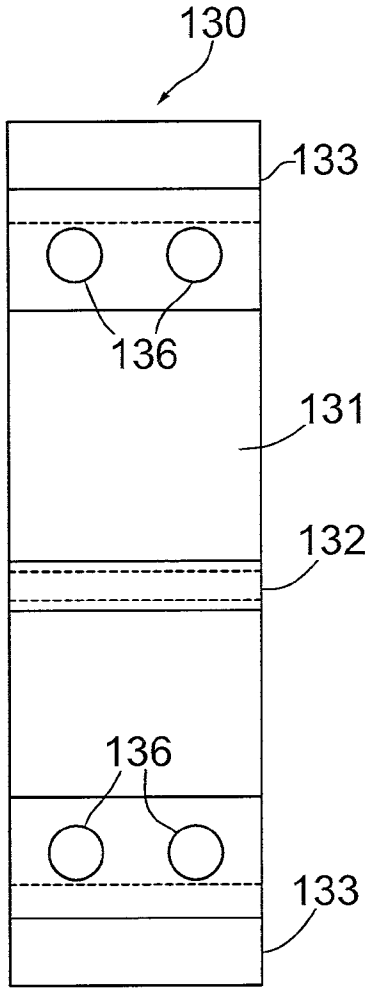
FIG. 4(*a*) is a side view of a thermal clip according to an embodiment of the present invention.
Figure 4A:
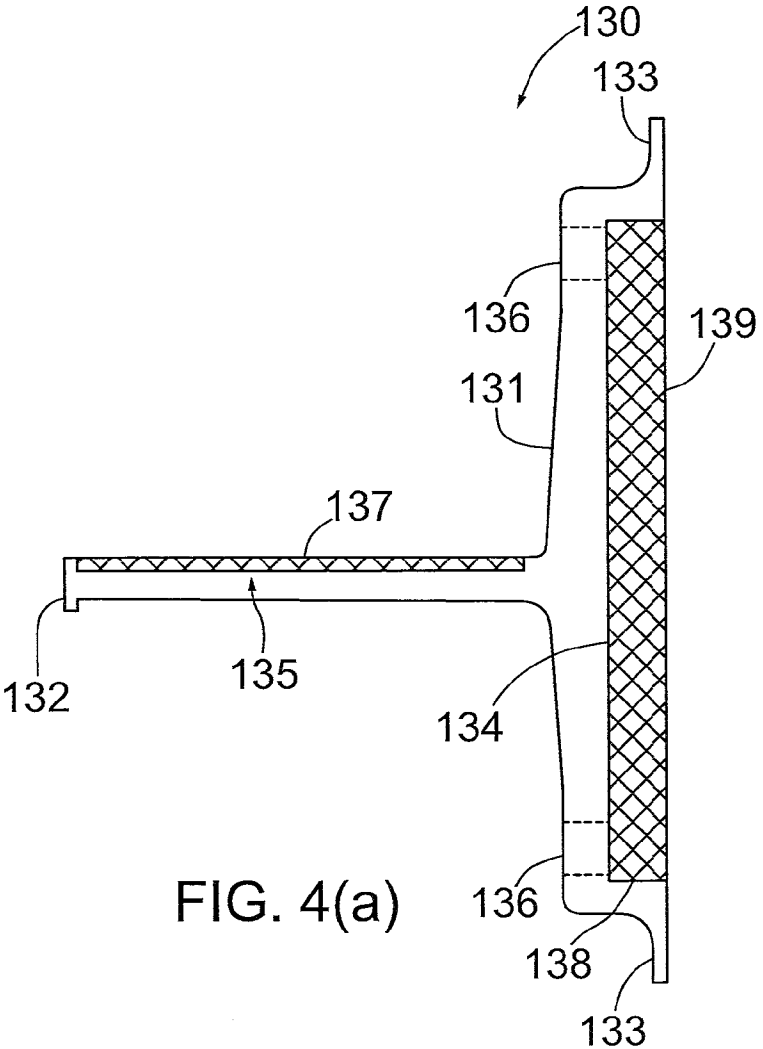
Figure 6B:
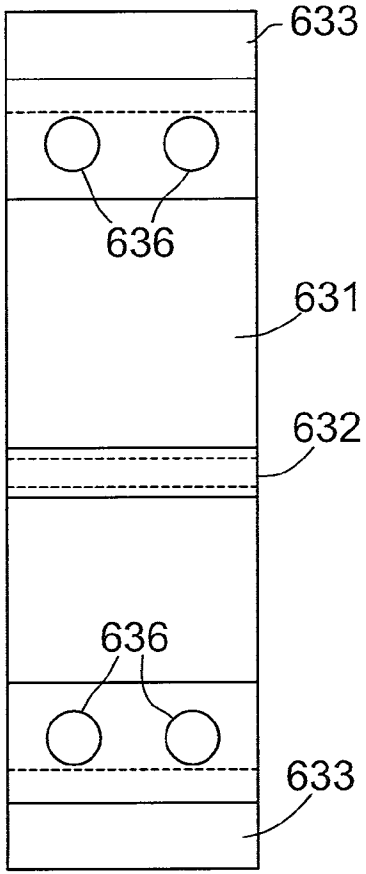
FIG. 6(*a*) is a side view of a thermal clip according to another embodiment of the present invention.
Figure 6A:
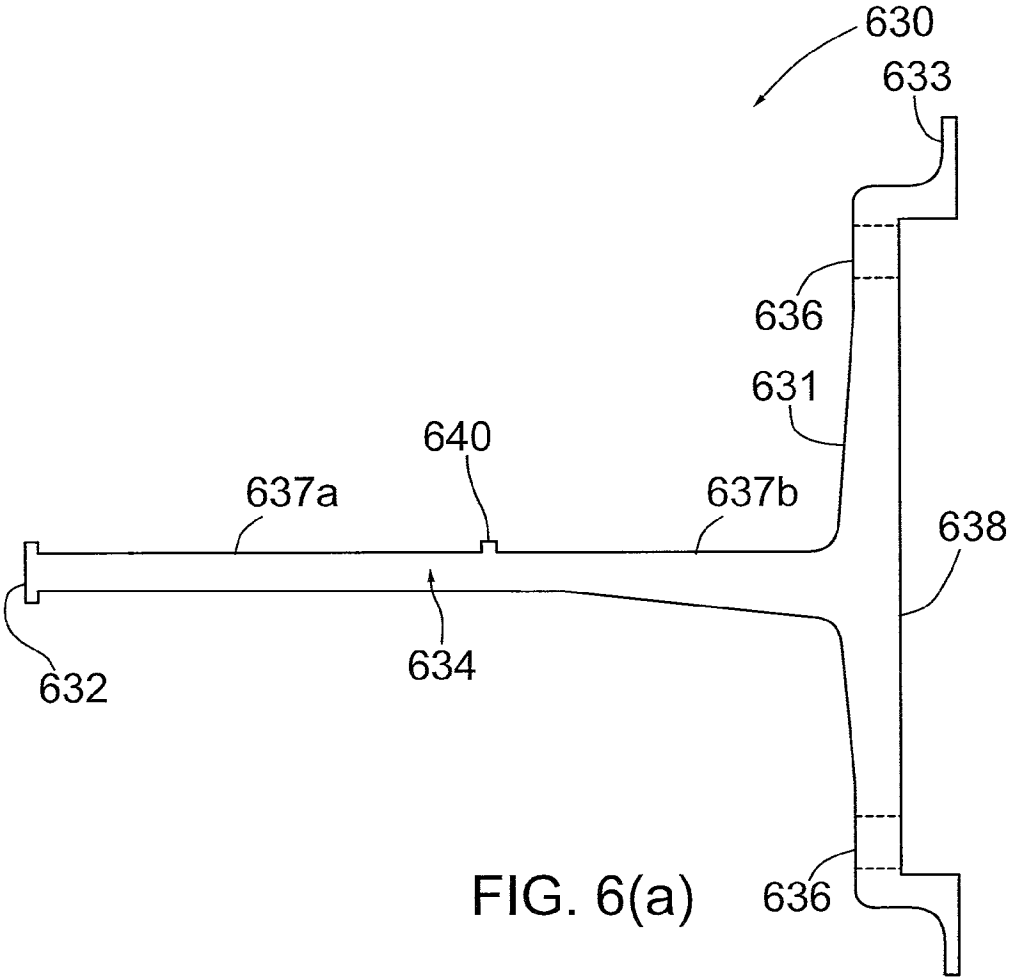

Reference is next made to FIGS. 6(*a*) and 6(*b*), which show a thermal clip according to another embodiment of the invention and indicated generally by reference 630. As compared to the thermal clip 130 of FIGS. 4(*a*), 4(*b*) and the thermal clip of FIGS. 5(*a*), 5(*b*), the thermal clip 630 is configured to provide an even greater span, in range of approximately 140 mm. The thermal clip 630 comprises a base section 631 and an arm section 632. The base section 631 is configured with openings 636 for receiving fasteners and securing the thermal clip to studs 110 in the wall 102, for example, as described above with reference to FIG. 3(*a*). The base section 630 may also include extended sections or feet indicated generally by reference 633 to provide an increased mounting surface for securing the base section 631 against the wall 102, and/or distributing the structural load. As described above with reference to FIGS. 3(*a*) and 3(*b*), the arm section 632 is generally perpendicular to the base section 631 and provides a surface for supporting and/or fastening the horizontal girt 120 (i.e. zee-girt). According to this embodiment, the longitudinal dimension of the arm section 632 has been increased, for example, to provide a greater span between the exterior wall 102 (FIG. 3(*a*)) and the exterior cladding layer 124 (FIG. 3(*a*)). According to an exemplary implementation, the thermal clip 630 is formed from extruded aluminum as a unitary piece. With the increased span (i.e. length) of the arm section 632 the thickness and/or material composition is suitably modified to accommodate the increased structural loading (e.g. bending moment loading).

As shown in FIG. 6(*a*), the thermal clip 630 may be configured with a recessed slot or cavity 638 in the base section 631 and/or a recessed slot or cavity 634 in the arm section 632. As described above for the thermal clip 530, the recessed slots 634, 636 are configured to receive or hold an insulating material and provide a thermal break between the thermal clip 630 and the exterior wall 102, and/or the horizontal sub-girt 120 (FIG. 3(*a*)) and the thermal clip 630, respectively. According to another aspect, the recessed slot 634 includes a cross-rib 640 which effectively divides the slot 634 into two sections 637*a* and 637*b*. The cross-rib 640 provides support surface for supporting the horizontal sub-girt 120 when it is mounted away from the base section 631, for example, in position 142*c* (FIG. 3(*a*)). With this configuration, each of slot sections 637*a* and 637*b* is configured to receive an insulating material or strip, for example, as described above.

It will be appreciated that while the embodiments of the clip were described as being fabricated from extruded aluminum, other materials and fabrication techniques, e.g. unitary and/or multi-component or welded configurations may be utilized.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A clip for a wall system, said wall system comprising one or more stud members configured for a wall and one or more girt members configured for connecting one or more external cladding panels, said clip comprising:

a base section having a mounting surface and being configured with one or more openings for receiving one or more respective fasteners for securing said base section to a respective one of the stud members;

an arm section extending generally perpendicularly from the said base section, and said arm section having a surface for supporting and securing a section of one of the girt members; and said base section having a recessed cavity formed in a section of said mounting surface, and said recessed cavity being configured for receiving and supporting an insulating material so as to provide a thermal break between said base section and the wall.

2. The clip as claimed in claim 1, wherein said base section and said arm section are formed as a unitary piece from a metallic material.

3. The clip as claimed in claim 2, wherein said insulating material comprises a silica aerogel insulation material.

4. The clip as claimed in claim 1, wherein the surface of said arm section further includes a recessed slot configured for receiving and supporting an insulating material so as to provide a thermal break between said girt member and said arm section.

5. An exterior wall assembly for a building comprising:

a backing wall comprising a plurality of stud members arranged in a spaced relationship;

a plurality of clip members fastened to respective stud members in said backing wall;

a plurality of horizontal girt members, each of said horizontal girt members having a mounting face;

a plurality of vertical girt members, each of said vertical girt members being configured for fastening to the mounting face of a respective one of said horizontal girt members to form a frame structure, and one or more of said vertical girt members having a mounting surface for attaching one or more exterior cladding panels; and each of said plurality of clip members comprising, a base section having a mounting surface and being configured with one or more openings for receiving one or more respective fasteners for securing said base section to a respective one of the stud members;

an arm section extending generally perpendicularly from the said base section, and said arm section having a surface for supporting and securing a section of one of said horizontal girt members; and said base section having a recessed cavity formed in a section of said mounting surface, and said recessed cavity being configured for receiving and supporting an insulating material so as to provide a thermal break between said base member and said backing wall.

6. The exterior wall assembly as claimed in claim 5, wherein said base section and said arm section are formed as a unitary piece from a metallic material.

7. The exterior wall assembly as claimed in claim 6, wherein said insulating material comprises a silica aerogel insulation material.

8. The exterior wall assembly as claimed in claim 5, wherein the surface of said arm section includes a recessed slot configured for receiving and supporting an insulating material so as to provide a thermal break between said horizontal member and said arm section.

* * * * *